United States Patent [19]

Osada

[11] Patent Number: 4,704,929

[45] Date of Patent: Nov. 10, 1987

[54] DEVICE FOR SETTING SCREW

[75] Inventor: Hiroshi Osada, Yokohama, Japan

[73] Assignee: Nifco Inc., Yohohama, Japan

[21] Appl. No.: 796,856

[22] Filed: Nov. 12, 1985

[30] Foreign Application Priority Data

Nov. 19, 1984 [JP] Japan ..... 59-174352[U]

[51] Int. Cl.[4] ..... B25B 23/08

[52] U.S. Cl. ..... 81/451; 81/452

[58] Field of Search ..... 173/31; 81/13, 10, 52, 81/53.2, 451, 452, 125

[56] References Cited

U.S. PATENT DOCUMENTS

| | | | |
|---|---|---|---|
| 739,606 | 9/1903 | Kemm | 81/452 |
| 1,063,304 | 6/1913 | Titus | 81/13 |
| 2,641,290 | 6/1953 | Webb | 81/451 |
| 2,765,828 | 10/1956 | Leniz | 81/451 |
| 4,526,072 | 7/1985 | Manhoff, Jr. | 81/451 |

*Primary Examiner*—E. R. Kazenske
*Assistant Examiner*—Willmon Fridie, Jr.
*Attorney, Agent, or Firm*—Trexler, Bushnell, Giangiorgi & Blackstone, Ltd.

[57] ABSTRACT

A device for setting a screw comprises a driver holder for receiving an end of a driver, a screw holder integral with the driver holder for retaining a head of a screw, and a pair of elastic pawls projecting inwardly from the peripheral wall of the driver holder for clamping the driver end, whereby the screw can be temporarily coupled to the driver end via the device.

3 Claims, 7 Drawing Figures

DEVICE FOR SETTING SCREW

FIELD OF THE INVENTION AND RELATED ART STATEMENT

This invention relates to a device for setting a screw, with which the screw is temporarily coupled to the tip end of a screw driver when the screw is to be driven at an inaccessable position such as at the bottom of a deep and narrow recess into which it is difficult to insert the fingers or at a ceiling surface which cannot be readily accessed by the hand.

Heretofore, when driving a screw at such a position it has been the practice to attract the screw onto the magnetized tip of a screw driver and to bring the screw to the place where it is to be driven as held on the tip of the screw driver by magnetic attraction.

With the prior art driver utilizing magnetism, however, the force of holding of the screw is weak. Therefore, unless the driver with the screw attracted thereto is moved slowly or quietly to bring the screw to the driving position, the screw will be readily detached from the driver due to its own weight. This means that the operability of this driver is very inferior.

Besides, after the leading end of the screw has been brought to the position of a screw hole, it is necessary to apply a precisely aligned perpendicular force to the driver. Otherwise, the end of the driver is liable to become detached from the slot in the screw head. Thus the screw is apt to fall in among other components of the equipment.

Further, during removal of the screw for maintenance of the equipment or the like, the screw is again apt to become detached from the driver because of the weak screw attracting force.

OBJECT AND SUMMARY OF THE INVENTION

An object of the invention, is to provide a device for setting a screw, with which a screw can be readily and reliably attached to the tip end of a screw driver.

To attain the above object, the invention provides a device for setting a screw comprising a cylindrical driver holder for holding the end of an inserted driver, a screw holder integral with the lower end of the driver holder for holding the head of a screw against vertical movement after the screw is fitted sidewise into the screw holder, and at least one elastic pawl projecting into the bore of the cylindrical driver holder for temporarily retaining the inserted driver.

According to the invention, the head of the screw is fitted sidewise in the screw holder to lock the screw therein, and then the end of the driver is inserted into the driver holder from the open top thereof to engage it with the groove formed in the screw head, whereby the screw is temporarily coupled to the driver via the device.

The driver inserted into the driver holder is clamped in the bore thereof by the elastic pawls, and it is held in the driver holder bore by the elastic force of the pawls. In this state, the device is coupled to the driver and does not become detached from the same when it is released. Thus, the device coupled to the driver can be brought to the screw driving position, and the screw can be driven by aligning the end thereof with the screw hole and then turning the driver. After the screw has been set in this way, the driver may be readily taken out from the driver holder, leaving the device together with the screw set in the screw hole.

When it becomes necessary to remove the screw for maintenance, the screw can be turned with the driver inserted into the bore of the driver holder of the device. The screw removed from the screw hole can be taken out together with the device as coupled to the driver with the screw held therein. The device which is taken out in this way can be used again.

DETAILED DESCRIPTION OF THE PREFERRED EMBODIMENT

Figure 1:
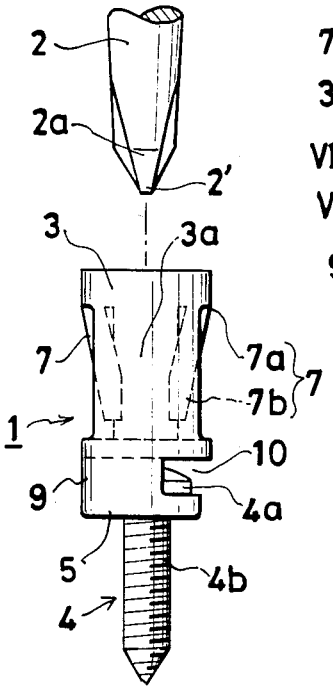
FIG. 1 is an exploded side view showing an embodiment of the device for setting screws according to the invention.
Figure 2:
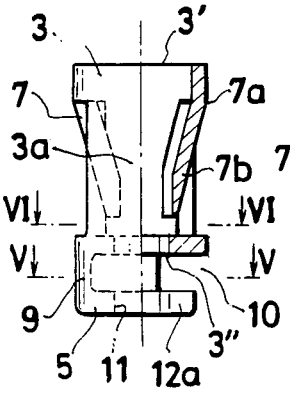
FIG. 2 is a side view with the right half in section showing the same embodiment.
Figure 3:
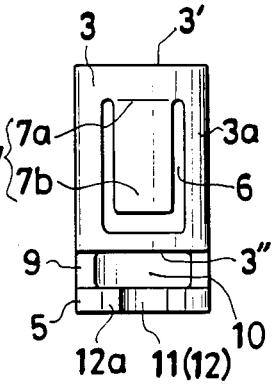
FIG. 3 is a side view showing the opposite side of the embodiment from that shown in FIG. 2.
Figure 6:
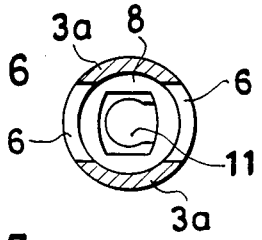
FIG. 6 is a sectional view taken along line VI—VI in FIG. 2.
Figure 4:
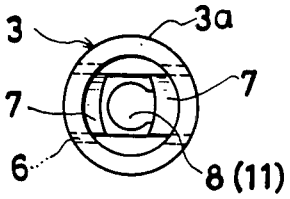
FIG. 4 is a plan view showing the embodiment.
Figure 5:
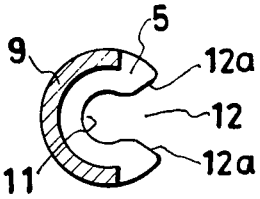
FIG. 5 is a sectional view taken along line V—V in FIG. 2.
Figure 7:
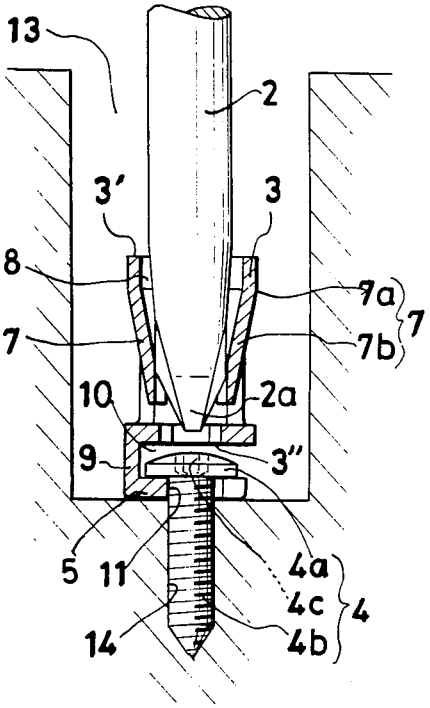
FIG. 7 is a view for explaining the use of the embodiment.

An embodiment of the invention will now be described with reference to the drawings. Referring to the figures, reference numeral 1 generally designates the device for setting a screw. The device 1 comprises a cylindrical driver holder 3, which can hold an end 2*a* of a driver 2 inserted into it, and a screw holder 5, which is integral with the lower end of the driver holder 3 and can hold a head 4*a* of a screw 4 against vertical movement after the screw has been fitted sidewise therein. The device is a one-piece molding of a plastic material.

The driver holder 3 is substantially cylindrical and open at the top and bottom. Its peripheral wall 3*a* is formed with a pair of upwardly channel-shaped notches 6. The portions surrounded by the notches 6 constitute elastic pawls 7 facing each other. The substantial portion 7*b* of each pawl 7 extends into the bore 8 of the driver holder 3 with the upper end of the pawl terminating in the remainder of the peripheral wall of the driver holder as a hinge 7*a*. In this embodiment, the two elastic pawls 7 extend closer to each other toward their lower free ends. The end 2*a* of the driver 2 thus can be guided by the inner sides of the elastic pawls 7 as it is inserted into the driver holder 3. The driver 2 thus can be readily aligned with the axis of the screw 4.

The screw holder 5 has a semicylindrical side wall 9 depending from the lower end of the driver holder 3, which defines a slit 10 between the lower end of the driver holder 3 and its lower end. The slit 10 opens sidewise and has a width sufficient to receive the head 4*a* of the screw 4. The bottom, radially extending wall of the screw holder 5 has a central hole 11 having a diameter sufficient to receive the threaded portion 4*b* of the screw 4. The central hole 11 is actually not a hole but is open sidewise in a sector-like fashion with the central hole 11 as its center. More specifically, the central hole 11 terminates in a guide notch 12 which opens sidewise in a direction coincidental with that in which the slit 10 opens. The opposite edges 12*a* of the guide notch 12 flare toward the open end to facilitate the insertion of the threaded portion 4*b* of the screw 4.

The device 1 having the above structure is used in the following way.

The screw 4, which has a cross-shaped slot 4c formed in the head 4a, is fitted in the screw holder 5. The screw 4 is fitted by pushing the threaded portion 4b into the central hole 11 through the guide notch 12 with the head 4a located at the open end of the slit 10. As the threaded portion 4b of the screw 4 is forced into the central hole 11 through the notch 12, the screw holder 5 is slightly spread, so that the threaded portion 4b is snappingly fitted in the central hole 11. At this time, the head 4a of the screw 4 is locked against vertical movement between the underside of the driver holder 3 and the upper surface of the bottom of the screw holder 5, and the slot 4c of the head 4a is aligned with an opening 3'' at the bottom of the driver holder 3.

Now, the end 2a of the driver 2 is inserted into the driver holder 3 from the open top 3' thereof. As the driver 2 is inserted, its end 2a comes into engagement with the elastic pawls 7 projecting into the bore 8 and causes the pawls 7 to flex outwardly against the elastic force. As the driver 2 is further advanced, its end penetrates the opening 3'' at the bottom of the driver holder and engages with the cross groove 4c of the screw head 4a. The driver 2 and screw 4 are thus coupled together via the driver holder 3.

In this state, the outer periphery of the end portion 2a of the driver 2 is held clamped between the pawls 7 by the elastic restoring force thereof. Thus, the device 1 and screw 4 will not be detached from the end portion 2a of the driver 2 even if the device 1 is released.

Thus, the screw 4 may be driven into a screw hole 14 at the bottom of a deep recess 13, for instance, into which the fingers cannot be inserted, by inserting the device 1 with the screw 4 held by the driver 2 into the recess 13 and then turning the driver 2. After the screw 4 has been completely driven, the driver 2 may be directly withdrawn from the driver holder 2. When the driver 2 is withdrawn, the elastic pawls 7 are restored to the initial state by the elastic force. The device 1 remains with the screw 4 which has been driven into the screw hole 14.

When it becomes necessary to remove the screw 4 for maintenance of the equipment or the like, the driver 2 is inserted into the driver holder 3 of the device 1 remaining in the recess 13, and the screw 4 is turned with the inserted driver 2. After the screw 4 is removed, it is only necessary to withdraw the driver 2. Since the outer periphery of the end portion 2a of the driver 2 is held clamped between the elastic pawls 7, the device 1 and screw 4 can be taken out together with the driver 2. The recovered device 1 may be readily used for another screw driving operation.

Further, since the driver holder 3 extends upright to a great extent from the head 4a of the mounted screw 4 and also the end portion 2a of the driver 2 is clamped by the elastic pawls 7, the driver 2 can be readily aligned with the head 4a of the screw when removing the screw 4. That is, otherwise necessary and troublesome searching for the slot 4c of the head 4a of the screw with the end of the driver 2 is not needed.

In the above embodiment the driver holder 3 is described as being cylindrical, but this is not limitative, and it is possible to use, for instance, a polygonal driver holder instead. Further, it is possible to provide two or more pairs of elastic pawls in place of the single pair of pawls 7. Furthermore, while in the above embodiment the elastic pawls 7 are formed by forming the notches 6, it is possible to provide mere protuberances. Further, the screw holder 5 can be of a different type from that in the aforesaid embodiment and need only satisfy the condition that the screw 4 can be inserted sidewise.

Further, when it is possible to insert the fingers or an appropriate tool into the recess 13 after the screw 4 has been driven to a slight extent into the screw hole 14, it is possible to once take out the driver 2 from the device 1, then recover the device 1 by removing it from the screw 4 and then driving the screw 4 again.

As has been described in the foregoing, according to the invention the screw to be driven can be temporarily coupled to the driver via the device. Thus, the driving of the screw into a screw hole at the bottom of a deep and narrow recess into which the fingers cannot be inserted or into a screw hole in a ceiling which cannot be readily accessed by hand, can be carried out conveniently and quickly. In addition, since the device can be left together with the mounted screw, the device facilitates the removal of the screw for maintenance of the equipment or the like, and prevents loss of the screw.

What is claimed is:

1. A device for setting a screw, comprising a cylindrical driver holder for holding an end of an inserted driver, a screw holder integral with the lower end of said driver holder for holding a head of a screw against vertical movement after said screw is fitted sidewise therein, and at least one elastic pawl projecting into the bore of said cylindrical driver holder for temporarily agressively retaining the inserted driver, said screw holder comprising a partially enclosing, axially extending wall having a radially opening slot therein for receiving sidewise insertion of the head of the screw, and a radially extending end wall remote from said driver holder, said end wall having a central hole for receiving a threaded portion of said screw and a peripheral guide notch opening radially through said end wall and communicating with said hole for sidewise insertion of said threaded portion through said notch into said hole to enable sidewise fit of the screw within said screw holder.

2. A device for setting a screw according to claim 1, wherein said driver holder has a pair of elastic pawls facing each other.

3. A device for setting a screw according to claim 1, wherein said guide notch has a sector-like configuration flaring toward said peripheral opening in the end wall.

* * * * *